United States Patent [19]

Hori et al.

[11] Patent Number: 4,850,625

[45] Date of Patent: Jul. 25, 1989

[54] AUTOMOTIVE DOOR LOCK DEVICE WITH ANTI-THEFT STRUCTURE

[75] Inventors: Yasuaki Hori; Fumio Kobayashi, both of Yokohama, Japan

[73] Assignee: Ohi Seisakusho Co., Ltd., Yokohama, Japan

[21] Appl. No.: 152,556

[22] Filed: Feb. 5, 1988

[30] Foreign Application Priority Data

Nov. 30, 1987 [JP] Japan ..... 62-299992

[51] Int. Cl.[4] ..... E05C 3/06

[52] U.S. Cl. ..... 292/336.3; 292/216

[58] Field of Search ..... 292/336.3, 337, 201, 292/216

[56] References Cited

U.S. PATENT DOCUMENTS

| | | | |
|---|---|---|---|
| 3,385,623 | 5/1968 | Burns et al. | 292/216 |
| 3,394,957 | 7/1968 | Foley | 292/336.3 X |
| 3,520,159 | 7/1970 | Swanney | 292/216 X |
| 3,608,941 | 9/1971 | Kondo | 292/216 X |
| 3,788,688 | 1/1974 | Chandler | 292/92 |
| 4,196,925 | 4/1980 | Torii | 292/336.3 X |
| 4,502,718 | 3/1985 | Sasaki et al. | 292/336.3 |
| 4,585,261 | 4/1926 | Adams et al. | 292/336.3 X |
| 4,603,894 | 8/1986 | Osenkowski | 292/337 X |
| 4,674,781 | 6/1987 | Reece et al. | 292/336.3 |

FOREIGN PATENT DOCUMENTS

| | | |
|---|---|---|
| 60-123685 | 7/1985 | Japan . |
| 2182389 | 5/1987 | United Kingdom . |

*Primary Examiner*—Kenneth J. Dorner
*Assistant Examiner*—Jose V. Chen
*Attorney, Agent, or Firm*—Foley & Lardner, Schwartz, Jeffery, Schwaab, Mack, Blumenthal & Evans

[57] ABSTRACT

Herein disclosed is a lock device for use with electrically operated and manually operated actuating devices, which comprises a housing structure, a locking and unlocking lever which is received in the housing structure and is pivotal between a first position to cause a locked state of the lock device and a second position to cause an unlocked state of the lock device, and a first concealing structure which is integrally connected to the housing structure and conceals a mechanical connection between one end of the locking and unlocking lever and the electrically operated actuating device. With this construction, a so-called anti-theft function of the lock device is provided. In order to achieve a much more assured anti-theft function, the lock device further has a second concealing structure which is integrally connected to the housing structure and conceals another mechanical connection between the other end of the locking and unlocking lever and the manually operated actuating device.

12 Claims, 2 Drawing Sheets

1
2
4
11
IV
B
4b
4a
6
13
10
4
14
3
17a
14a
17
15a
15

25
1
12
13
10
4
9
4a
4b
R
7a
7
6
5
III
15a
14a
17
B
2
A
7b
8
14
16

AUTOMOTIVE DOOR LOCK DEVICE WITH ANIT-THEFT STRUCTURE

BACKGROUND OF THE INVENTION

1. Field of the Invention

The present invention relates in general to automotive door lock devices, and more particularly to automotive door lock devices of a type which is equipped with an anti-theft structure.

2. Description of the Prior Art

In automotive door lock devices nowadays used, there is a type in which the control section thereof is provided with a so-called locking and unlocking lever which pivots between a locking position to lock the lock device and an unlocking position to unlock the lock device. Usually, the locking and unlocking lever is connected through respective connecting rods to a key cylinder device and a locking knob which are mounted on the door.

While, in door lock devices of an electric type which is equipped with an electric actuator to drive the locking and unlocking lever to the locking or unlocking position remotely from a driver's position, the connection between the locking and unlocking lever and the actuator is achieved mechanically through a connecting rod. One of the door lock devices of this type is disclosed in Japanese Patent First Provisional Publication No. 60 123685.

However, in the door lock devices of the above-mentioned conventional types, a pivotally jointed portion between the locking and unlocking lever and the connecting rod is exposed to the outside of the housing of the door lock device. However, this exposed jointed portion causes the door lock device to be easily tampered with. That is, a pick (e.g., a hooked wire or the like) wrongfully inserted into the door assembly from outside can unlock the door by tampering the jointed portion.

SUMMARY OF THE INVENTION

It is therefore an object of the present invention to provide an automotive door lock device with an improved anti-theft structure.

It is another object of the present invention to provide an automotive door lock device with anti-theft structure, which is simple in construction.

According to the present invention, there is provided an improved lock device for use with first and second actuating means. The lock device comprises a housing structure, a locking and unlocking lever pivotally disposed in the housing structure, the lever pivoting between a first position to cause a locked state of the lock device and a second position to cause an unlocked state of the same, and first concealing means for concealing a first mechanical connection between a first end of the locking and unlocking lever and the first actuating means.

BRIEF DESCRIPTION OF THE DRAWINGS

Other objects and advantages of the present invention will be apparent from the following description when taken in conjunction with the accompanying drawings, in which.

DETAILED DESCRIPTION OF THE INVENTION

Figure 1:
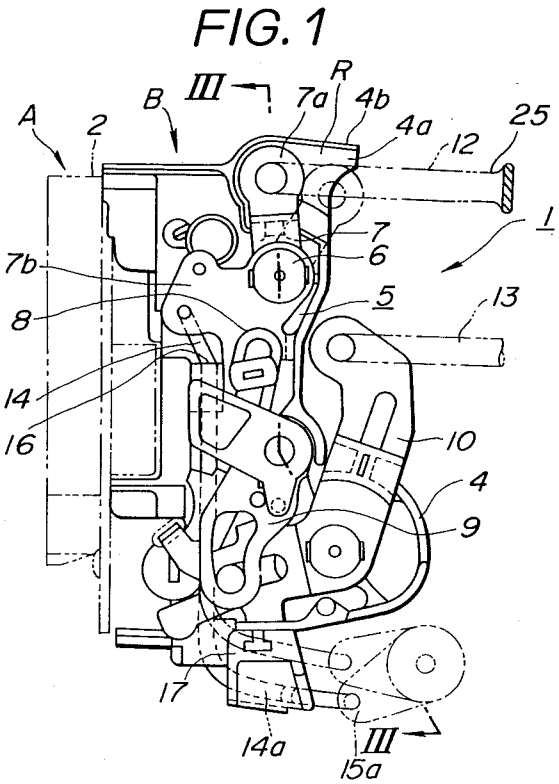
FIG. 1 is a front view of a door lock device according to the present invention, but with a base plate removed.

Referring to the drawings, there is shown a door lock device 1 of the present invention, which is adapted to be mounted to a rear door (not shown) of a motor vehicle. FIG. 1 is a front view of the door lock device 1 with a base plate removed for clarification of arrangement of parts installed therein.

The door lock device 1 comprises generally a latch section A and a control section B which are assembled to form a generally L-shaped structure. The latch section A comprises known latch and pawl plates which are housed in a plastic housing 2. One side of the plastic housing 2 is fixed to one wing portion of a generally L-shaped base plate 3 of metal (not shown in FIG. 1) which has the other wing portion on which the control section B is mounted. The control section B comprises a so-called locking and unlocking mechanism 5 (which will be referred to as L-U mechanism hereinafter for ease of description) which is arranged within a space defined between a plastic cover 4 and the other wing portion of the base plate 3.

The L-U mechanism 5 comprises a so-called locking and unlocking lever 7 (which will be referred to as L-U lever hereinafter) which is connected through a pivot shaft 6 to the plastic cover 4 to pivot between a locking position and an unlocking position. These locking and unlocking positions of the L-U lever 7 induce the locked and unlocked conditions of the lock device 1, respectively. A sub-lever 8, a child proof lever 9 and an inside lever 10 are incorporated with the L-U lever 7 in a known manner. Designated by numeral 11 (see FIG. 3) is an outside lever which is pivotally connected to the plastic housing 2 of the latch section A.

Figure 3:
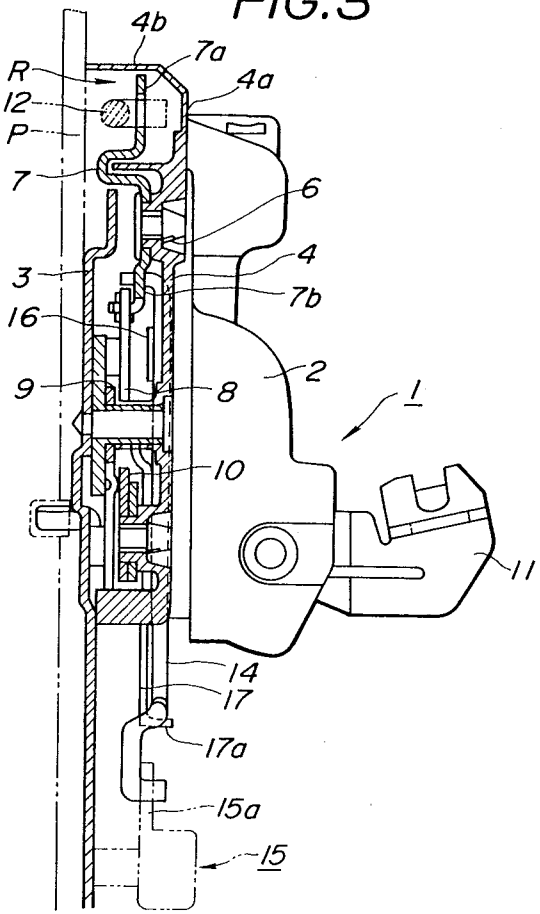
FIG. 3 is a sectional view taken along the line III—III of FIG. 1.

As will be from FIGS. 1 and 3, an upper portion or second end portion *7a* of the L-U lever 7 is spacedly received in a recess R provided by the plastic cover 4. That is, the recess R is defined by a bottom wall *4a* integral with a major part of the plastic cover 4 and a curved side wall *4b* extending along a peripheral portion of the bottom wall *4a*. As is seen from FIG. 3, the side wall *4b* is sized to reach an imaginary flat plane which includes a major flat part of the base plate 3. That is, the upper portion *7a* of the L-U lever 7 is neatly concealed by the bottom wall *4a* and the side wall *4b* for the purpose which will become apparent as the description proceeds.

The upper portion *7a* of the L-U lever 7 is pivotally connected to a rod 12 which leads to a locking knob 25 which is mounted to the door and operable from inside of the vehicle. That is, as is understood FIG. 1, when the locking knob 25 is pushed into the door assembly to assume its operative or locking position, the L-U lever 7 assumes the locking position as illustrated by a solid line, while, when the locking knob 25 is pulled up from the door, the L-U lever 7 assumes the unlocking position as illustrated by a phantom line. This locking knob comprises an actuating means for lever 7.

The inside lever 10 is connected through a rod 13 to an inside handle (not shown) which is mounted to an inboard side of the door. When, with the L-U lever 7 assuming the unlocking position, the inside handle is manipulated, the door lock device 1 unlatches the door from the vehicle body. Thus, under this condition, the door can be opened from inside of the vehicle.

Figure 2:
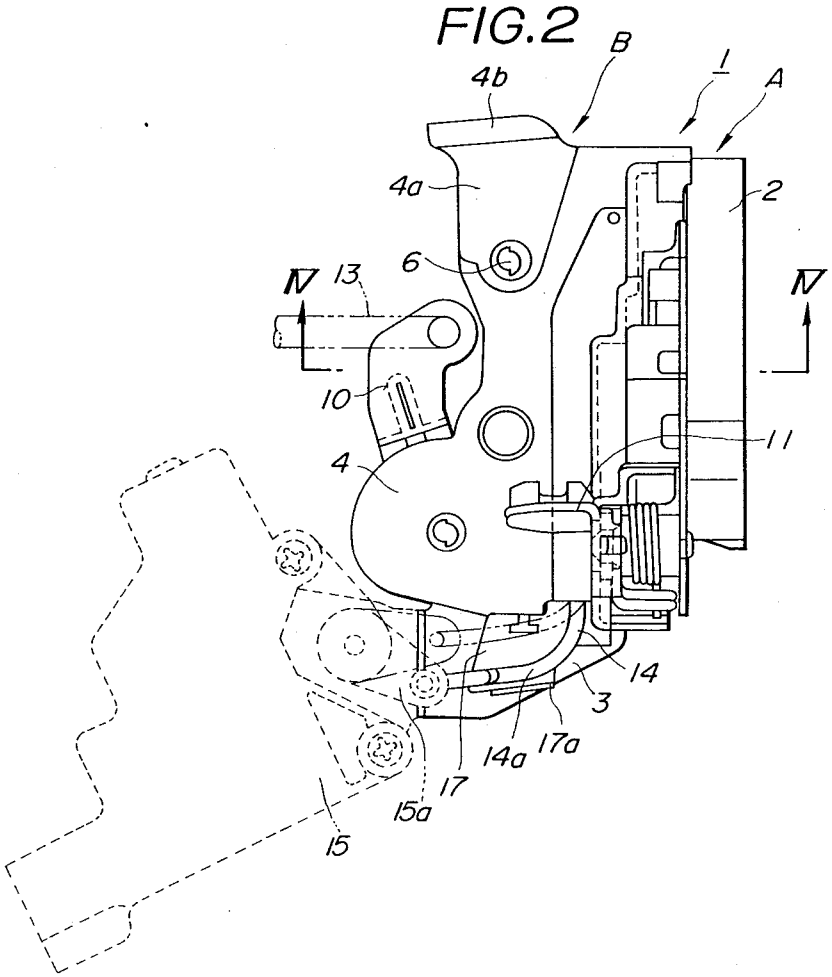
FIG. 2 is a back view of the door lock device.

A lower portion or first end portion 7b of the L-U lever 7 is somewhat enlarged and positioned in the space between the plastic cover 4 and the other wing portion of the base plate 3, that is, the space within which the L-U mechanism 5 is installed. The lower portion 7b of the L-U lever 7 is pivotally connected to a rod 14 which extends therefrom to an electric actuator 15. As will become apparent as the description proceeds, due to operation of the electric actuator 15, the rod 14 is moved upward or downward to pivot the L-U lever 7 to the unlocking position or the locking position. As is seen from FIG. 2, the rod 14 has a generally L-shaped lower portion 14a which gets out of said space and leads to a drive lever 15a of the electric actuator 15. The actuator 15 is fixed to an extension portion of the base plate 3.

Figure 4:
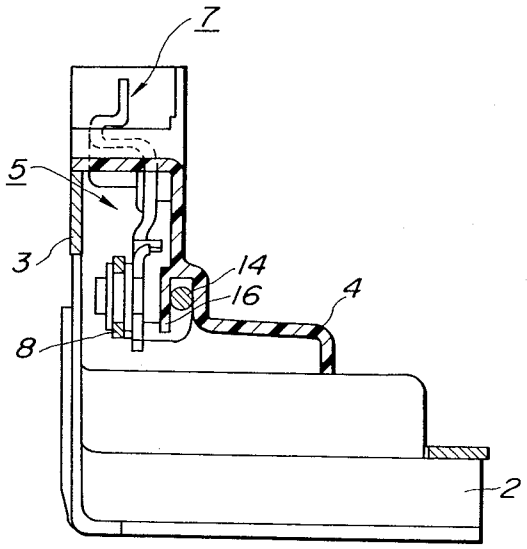
FIG. 4 is a sectional view taken along the line IV—IV of FIG. 2.

As is seen from FIGS. 3 and 4, an upper straight portion of the rod 14 is slidably held by a guide portion which is defined by the plastic cover 4 within said space. That is, the guide portion comprises an inner wall of the cover 4 and a guide piece 16 raised from the cover 4, which are arranged to form therebetween a straight groove in which the upper straight portion of the rod 14 is slidably received.

The L-shaped lower portion 14a of the rod 14 projects outwardly from an open slot formed in a lower end of the plastic cover 4 and extends along a stepped side wall portion (no numeral) of a holder 17. The holder 17 is constructed of plastics and has a lower wall portion 17a which is shaped to conceal the curved lower portion 14a of the rod 14. Because of provision of the guide portion and the holder 17, the rod 14 is prevented from suffering a play.

The electric actuator 15 is connected through lead wires (not shown) to a control switch unit (not shown) mounted near the driver's seat. That is, upon manipulation of the control switch unit, the electric actuator 15 pivots the drive lever 15a thereof and thus moves the rod 14 upward or downward.

As is seen from FIG. 3, when mounted to a door, the lock device 1 is so oriented that the other wing portion of the base plate 3 faces an inner panel P of the door. Thus, under this condition, the mouth portion of the recess R is covered with the inner panel P. That is, the peripheral edge of the side wall 4b of the recess R is in contact with or at least positioned close to an inner surface of the inner panel P.

Thus, upon mounting to the door, the upper portion 7a of the L-U lever 7, to which the rod 12 is pivotally connected (see FIG. 1), is almost concealed by the cave construction (which constitutes a second concealing means) thus formed except a portion thereof which is directed to the rod 12. Thus, due to this cave construction, the upper portion 7a of the L-U lever 7 is prevented from being tampered by a pick, such as a hooked wire or the like, which is wrongfully inserted into the door assembly from outside.

Furthermore, since the exposed L-shaped lower portion 14a of the rod 14, to which the L-U lever 7 is connected, is concealed by the lower wall portion 17a (which constitutes a first concealing means) of the holder 17 as is described hereinabove, the portion 14a is prevented from being tampered by the pick.

As will be understood from the foregoing description, the door lock device 1 of the invention possesses a high anti-theft performance due to its concealing structure by which exposed parts of the L-U lever are concealed.

Although the foregoing description is directed to an embodiment concretely shown in the drawings, the prevent invention is applicable to the other lock devices of a type wherein the L-U lever 7 is connected to the electric actuator 15 through a straight rod and of a type wherein a known link mechanism is used in place of the rod 14.

What is claimed is:

1. A lock device comprising:

a latch section;

a cover covering said latch section to prevent tampering; and a latch control section, comprising:

a housing structure;

a first actuating means;

a locking and unlocking lever pivotally disposed in said housing structure, said lever pivoting between a first position to cause a locked state of the lock device and a second position to cause an unlocked state of the same;

means for connecting said locking and unlocking lever to said latch section to operate said latch section, said lever connecting means being totally enclosed by said cover and said housing structure to prevent tampering;

a first rod which has one end pivotally connected within said housing structure to a first end of said locking and unlocking lever and has another end projected outwardly from said housing structure and pivotally connected at a first mechanical connection to a drive lever of said first actuating means; and a first concealing means for concealing said first mechanical connection to prevent tampering, said first concealing means comprising a portion of said housing positioned on one side of said first mechanical connection and a holder which is connected to said housing structure and formed with a wall portion which is shaped to conceal the outwardly projected end of said first rod.

2. A lock device as claimed in claim 1, further comprising second concealing means for concealing a second mechanical connection between a second end of a locking and unlocking lever and said second actuating means.

3. A lock device as claimed in claim 2, in which said second mechanical connection comprises a second rod which has one end pivotally connected to said second end of said locking and unlocking lever.

4. A lock device as claimed in claim 2, in which said housing structure comprises a base plate of metal and a plastic cover, said base plate and said plastic cover being assembled to form therebetween a space in which said locking and unlocking lever is pivotally disposed.

5. A lock device as claimed in claim 4, in which said first end of said locking and unlocking lever is received in said housing structure.

6. A lock device as claimed in claim 4, in which said second concealing means comprises a recess integrally defined by said plastic cover, said second end of said locking and unlocking lever being located within said recess.

7. A lock device as claimed in claim 6, in which said recess has an opening which is directed toward said second rod.

8. A lock device as claimed in claim 6, in which the recess is covered with a panel of a door structure when said lock device is properly mounted to said door structure.

9. A lock device as claimed in claim 1, in which a part of said first rod is slidably received in a groove provided within said housing structure.

10. A lock device as claimed in claim 9, in which the outwardly projected end of said first rod is curved.

11. A lock device as claimed in claim 10, in which said first actuating means is an electrically operated actuator which, upon energization, pivots said drive lever thereof and thus moves said first rod.

12. A lock device as claimed in claim 11, in which said housing structure is formed with an aperture through which said second end of said locking and unlocking lever is exposed to the outside of the housing structure.

* * * * *